US007631994B2

(12) United States Patent
Halliwell et al.

(10) Patent No.: US 7,631,994 B2
(45) Date of Patent: Dec. 15, 2009

(54) MOUNTING SYSTEM FOR A LIGHT FIXTURE

(75) Inventors: Brian John Halliwell, Walnut, CA (US); Usman Vakil, Walnut, CA (US)

(73) Assignee: Lights of America, Inc., Walnut, CA (US)

( * ) Notice: Subject to any disclaimer, the term of this patent is extended or adjusted under 35 U.S.C. 154(b) by 452 days.

(21) Appl. No.: 11/179,075

(22) Filed: Jul. 11, 2005

(65) Prior Publication Data

US 2007/0008731 A1 Jan. 11, 2007

(51) Int. Cl.
*F21S 8/06* (2006.01)
*F21S 8/00* (2006.01)

(52) U.S. Cl. ..... 362/408; 362/147; 362/388; 362/404

(58) Field of Classification Search ..... 362/147–148, 362/388, 404–408, 397, 343, 150; 248/343
See application file for complete search history.

(56) References Cited

U.S. PATENT DOCUMENTS 1,383,831 A * 7/1921 Leimecke ..... 362/307
2,007,040 A * 7/1935 Doane ..... 362/235
5,491,618 A * 2/1996 Vakil ..... 362/147
5,568,969 A * 10/1996 Yu ..... 362/404
6,439,740 B1 * 8/2002 Yan ..... 362/216
6,494,589 B1 * 12/2002 Shyu ..... 362/96
6,669,159 B1 * 12/2003 Hsu ..... 248/343
2005/0099817 A1 * 5/2005 Lin ..... 362/404

* cited by examiner

*Primary Examiner*—Sharon E Payne
*Assistant Examiner*—Sean P Gramling
(74) *Attorney, Agent, or Firm*—Kuta IP Law LLC; Christina M. Kuta

(57) ABSTRACT

A mounting system for a light fixture includes a lamp holder and a mounting device coupled to the holder where the mounting device enables the lamp holder to be mounted in one of a plurality of mounting modes. The mounting modes include a flush mode, a semi-flush mode and attachment to a ceiling fan. The lamps that may be used in the light fixture include a fluorescent lamp, an incandescent, or a halogen lamp. The light fixture with the mounting system that enables multiple mounting modes can be provided as a single product in a single package.

6 Claims, 10 Drawing Sheets

MOUNTING SYSTEM FOR A LIGHT FIXTURE

BACKGROUND

Light fixtures are installed in different modes for both practical and aesthetic reasons. Often light fixtures are installed "overhead" to a ceiling or other mounting surface. Installation modes includes flush mount in which there is little or no space between the light fixture and the mounting surface and semi-flush mount in which the light fixture is positioned some distance away from the mounting surface. Another mounting mode involves attaching a light fixture to an overhead fan fixture. Overhead fans with lights are also referred to as "lighting fans".

Light fixtures configured to be installed in a flush mount mode, semi-flush mount mode or as a part of an overhead fan compose a large portion of lighting applications in residential and commercial buildings. Manufacturers, wholesalers, distributors and retailers that manufacturer, distribute and market light fixtures to be mounted in these three modes all face the same challenge. This challenge is the challenge of dealing with the number of units in separate packages that need to be shipped, warehoused and shelved in retail. The various mounting modes require entirely different configurations in the mounting portion of the light fixture. Consequently, a fixture design to be mounted in the various modes is generally manufactured, marketed and distributed in separate packages, one package for each mounting mode. This means that essentially one light fixture is manufactured, marketed and distributed as several different products, each product in its own package. Accordingly, manufacturers, wholesalers, distributors and retailers are required to warehouse and stock a number of different packages for essentially one lamp design.

Providing and maintaining multiple packages for a single light fixture design consumes valuable warehouse and retail shelf space and limits the number of different fixture designs that the retailer, wholesaler, distributor and manufacturer can offer. Accordingly, potential sales of other light fixtures designs are also reduced because there is not enough shelf space in which to offer other designs for sale.

For the foregoing reasons, there is a need for a combined light fixture mounting system so that a light fixture may be provided with one of several mounting modes in a single package.

SUMMARY

The present invention is directed to a plural mode mounting system for light fixtures. Specifically, embodiments of the present invention of a plural mounting mode system enable a single light fixture design to be mounted in a number of different modes. The mounting modes include, for example, flush mode, semi-flush mode or as part of a ceiling fan. The light fixture having multiple mounting modes can be provided as a single product in a single package thereby obviating the practice of packaging the same lighting fixture design in a separate package for each mounting mode.

Embodiments of the invention include a mounting system for a light fixture having a holder to receive a lamp and a plural-mode mounting device coupled to the holder. The plural-mode mounting device enables the holder holding a lamp to be mounted in one of a plurality of mounting modes. The mounting modes include a flush mount mode, a semi-flush mount mode and a ceiling fan mount mode.

In an alternative embodiment of the invention, the mounting system with a plural mode mounting device enables the light fixture to be mounted in one of the plurality of mounting modes without alteration of the plural-mode mounting device.

In another embodiment of the invention, the mounting device in the mounting system is a cylinder having a disk mounted substantially coaxially inside the cylinder. The disk has a lower surface where the lower surface and sides of the cylinder below the disk define a lamp cavity to receive the lamp into the cylinder. Further, the lower surface has at least one lamp mounting feature to hold the lamp. The lamp in the light fixture may be a fluorescent lamp, an incandescent lamp, or a halogen lamp.

In another embodiment of the invention, the mounting device in the mounting system is a cylinder and a disk mounted substantially coaxially inside the cylinder. The disk has an upper surface where the upper surface has at least one flush mount feature, at least one semi-flush mount feature and at least one fan-mount feature. The mounting device provides features for a variety of mounting modes so that any of these modes can be accomplished with the same part.

In an alternate arrangement, the at least one flush mount feature is a center aperture shaped and configured to receive a center mounting stud to attach the light fixture to a ceiling brace in a flush mount manner.

In another embodiment of the invention, the at least one flush mount feature includes a mounting cavity defined by the upper surface of the disk and the inner surface of the cylinder above the disk. The mounting cavity is able to receive a ceiling brace and the center mounting stud to enable the light fixture to be mounted in a flush mount manner.

In another embodiment of the invention, the mounting system includes a mounting plate having a smaller circumference than the cylinder. The mounting plate has a rim. A plurality of studs extends radially from the rim of the mounting plate. Each stud in the plurality is spaced apart from the others. In this embodiment, the at least one flush mount feature is a plurality of slots. Each slot receives one of the plurality of studs, and each slot is configured so that when the studs are received into the slots and the mounting device is turned, the mounting device and mounting plate are coupled.

In an alternate arrangement, the mounting system includes a mounting plate having a smaller circumference than the cylinder. The mounting plate has a rim and at least two plate tabs extending radially outward from the rim. Further, the cylinder has tabs extending radially inward. The tabs extending radially inward from the cylinder are located and configured to rest on top of the mounting plate tabs thereby coupling the plural-mount mounting device to the mounting plate such that the light fixture is mounted in a flush mount manner.

In a further alternative arrangement, the mounting device includes a mounting cavity defined by the upper surface of the disk and the inner surface of the cylinder above the disk. The mounting cavity receives the mounting plate and the plate tabs to enable the light fixture to be mounted in a flush mount manner.

In another alternative embodiment of the invention, the mounting system includes a mounting plate having a smaller circumference than the cylinder. In this embodiment, the mounting plate has at least two circumferential slots where each slot has a larger end and a smaller end. The at least one flush mount feature includes at least two pins having enlarged heads coupled to the disk in the mounting device. The at least two pins extend upward substantially parallel to the axis of the cylinder where the at least two pins are shaped and located to be received into the larger ends of the slots. The enlarged heads are larger than the smaller ends of the slots such that the plural-mode mounting device and mounting plate are coupled when the pins are inserted into the slots and the mounting device is then turned so that the pins are located at the smaller ends of the slots. In this way, the light fixture is mounted in a flush mount manner. In an alternative arrangement, the at least two pins are long, such that the light fixture is mounted in a semi-flush manner.

In another embodiment of the invention, the at least one semi-flush mount feature is a substantially centrally located aperture configured to receive a mounting rod. In one arrangement, the mounting rod and aperture are threaded. In another arrangement, the mounting rod is a locking rod. In an alternative arrangement, a plurality of mounting rods is coupled to the mounting device and the mounting plate to attach the light fixture to an overhead surface in a semi-flush mode.

In another embodiment of the invention, the mounting device includes a plurality of holes in the disk to allow light from the lamp through the disk for upward illumination in the semi-flush mounting mode.

In another embodiment of the invention, the at least one fan-mount feature is a mount cavity defined by the upper surface of the disk and the inner surface of the cylinder. The disk is recessed from the upper edge of the cylinder such that a fan mounting plate can be received into the mount cavity.

In one arrangement of the invention, the cylinder of the mount device is tapered.

In another embodiment of the invention, the mount device includes a channel for light fixture wires. In one arrangement of the invention, the channel is contained in a flush mount feature of the mounting device. In an alternative arrangement of the invention, the channel is contained in a semi-flush mount feature of the mounting device. In another alternative arrangement of the invention, the channel is contained in a fan-mount feature of the mounting device. In this way, the lamp wiring is contained and made efficiently available for lamp installation purposes.

The present invention together with the above and other advantages may best be understood from the following detailed description of the embodiments of the invention illustrated in the drawings, wherein:

DRAWINGS

DESCRIPTION

A plural-mode mounting system enables a light fixture to be mounted in one of several different modes. The modes include flush mount, semi-flush mount and mounting to a ceiling fan. The single mounting system of the present invention replaces the conventional plurality of mounting configurations. This results in the ability to provide the light fixture as a single product rather than as several products, one for each mounting configuration.

Figure 1:
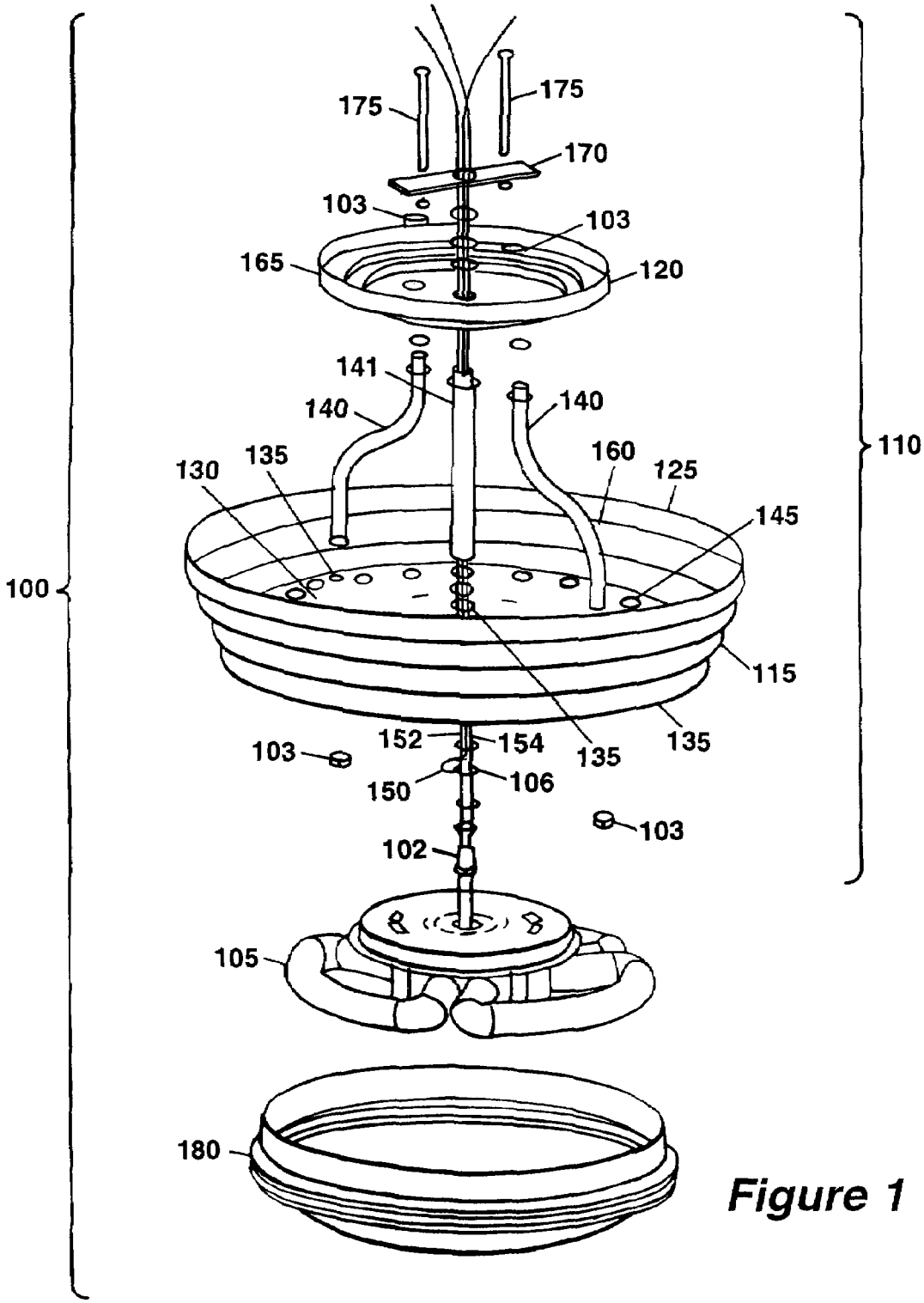
FIG. 1 is an assembly view of a light fixture having a plural-mount system according to principles of the invention.

FIG. 1 shows an exploded view of an overhead lighting system 100 including a light fixture 105 and a plural-mode mounting system 110 according to one embodiment of the invention. In the embodiment shown in FIG. 1, the light fixture 105 is a fluorescent lamp, however, in alternative embodiments, the light fixture 105 is a halogen lamp or an incandescent lamp. Other types of lamps are possible within the scope of the invention. The present invention is not limited to those lamps listed here. The light fixture 105 is coupled to the plural-mode mounting system 110 with a center mounting stud 102 and a nut 103. A ground ring terminal 106 is provided in this coupling for electrical purposes. understand that a wide variety of methods for coupling the mounting rods to the mounting platform 130 are possible.

The mounting platform 130 also includes a plurality of through-holes 145 which, in the present embodiment, are located just inside the circumference of the mounting platform 130. The through-holes 145 enable light from the light fixture 105 through the mounting device 115 for indirect lighting when the lamp system 100 is mounted in a semi-flush mode. In some embodiments of the invention, the body 125 of the mounting device 115 is tapered with the wider end directed upward. This further enables indirect lighting when the lamp system 100 is mounted in a semi-flush mode.

The mounting rods 140, 141 are coupled to the mounting platform 130 and to the mounting plate 120. In the present embodiment, the mounting rods 140, 141 are threaded as described above. In the present embodiment, the mounting rods 140, 141 are hollow. The hollow center mounting rod 141 and the hollow mounting stud 102 provide a channel for the light fixture wiring, that is the ground wire 150 and the positive 152 and negative 154 wires. In the present embodiment, the center rod 141 is shown as straight with curved mounting rods 140 positioned on either side of the center rod 141. In an alternative embodiment, all the mounting rods 140, 141 are straight rods. Other rod configurations are possible within the scope of the invention.

The mounting plate 120 is generally disk-shaped with a smaller circumference than the body 125 of the mounting device 115. The mounting plate 120 further includes a rim 165. The smaller circumference enables the mounting plate 120 to be received into the cavity 160 formed by the inner surface of the body 125 and upper surface of the mounting platform 130 of the mounting device 115 for some of the flush mount embodiments that will be described below. In one arrangement, the mounting plate 120 holds the mounting rods 140, 141 but also provides a cover for connection and electrical hardware in a support surface (not shown) for the lamp 100. In another arrangement, the mounting plate provides through holes for the mounting rods 140, 141 that are coupled to the mounting surface, such as a ceiling (not shown) as will be described below. Alternative embodiments for the mounting plate 120 include a square-shaped mounting plate, a rimless mounting plate, and a mounting plate that has an equal or larger circumference than the body 125 of the mounting device 115. The mounting plate 120 may be made of similar materials as the mounting device 115.

The mounting plate 120 is coupled to the mounting surface (not shown) with a cross bar 170 and mounting screws 175. In one embodiment, the mounting rods 140, 141 are also coupled to the cross bar 170.

A diffuser 180 is coupled to the mounting device 115 covering the light fixture 105. The diffuser 180 is made of a transparent or translucent material such as glass or plastic.

The configuration of the mounting system 110 in the lamp system 100 shown in FIG. 1 is for mounting the light fixture 105 in a semi-flush mode. The mounting rods 140, 141 coupled between the mounting device 115 and the mounting plate 120 are long enough to support the light fixture 105 coupled to the mounting device 115 at some distance away from the mounting surface to which the mounting plate 120 and cross bar 170 are coupled. In an alternative embodiment, to accomplish a flush mount, shorter mounting rods 140, 141 or a single shorter mounting rod 141 is used to couple the mounting device 115 to the mounting plate 120 or cross bar 170.

Figure 2:
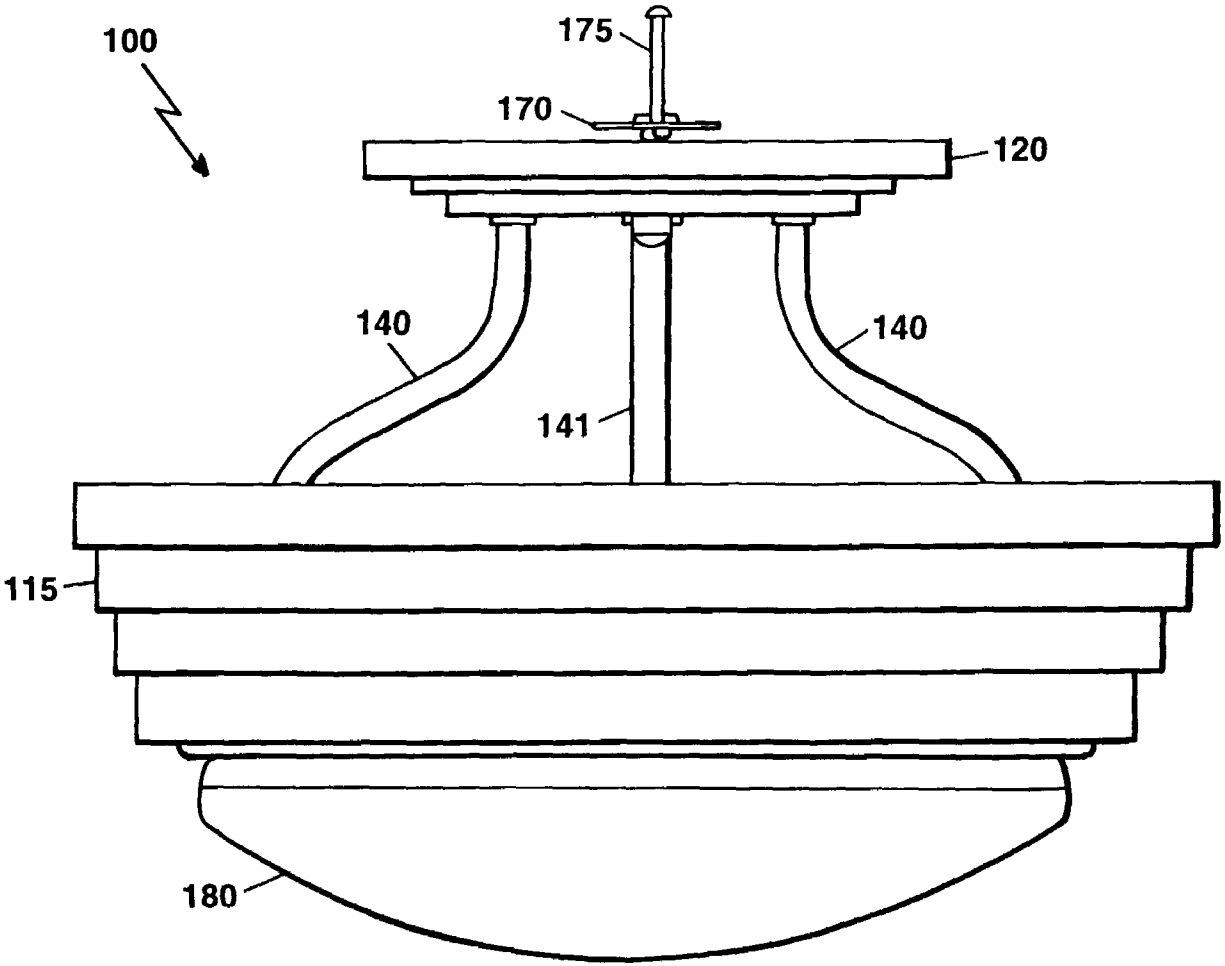
FIG. 2 is a side view of the light fixture of FIG. 1.

FIG. 2 is a side view of the lamp system 100 of FIG. 1 assembled in a semi-flush mounting mode configuration. The diffuser 180 is coupled to the mounting device 115 covering the light fixture 105 which is consequently not visible in this view. The mounting rods 140, 141 are coupled to the mounting plate 120 which in turn is coupled to the cross bar.

Figure 3:
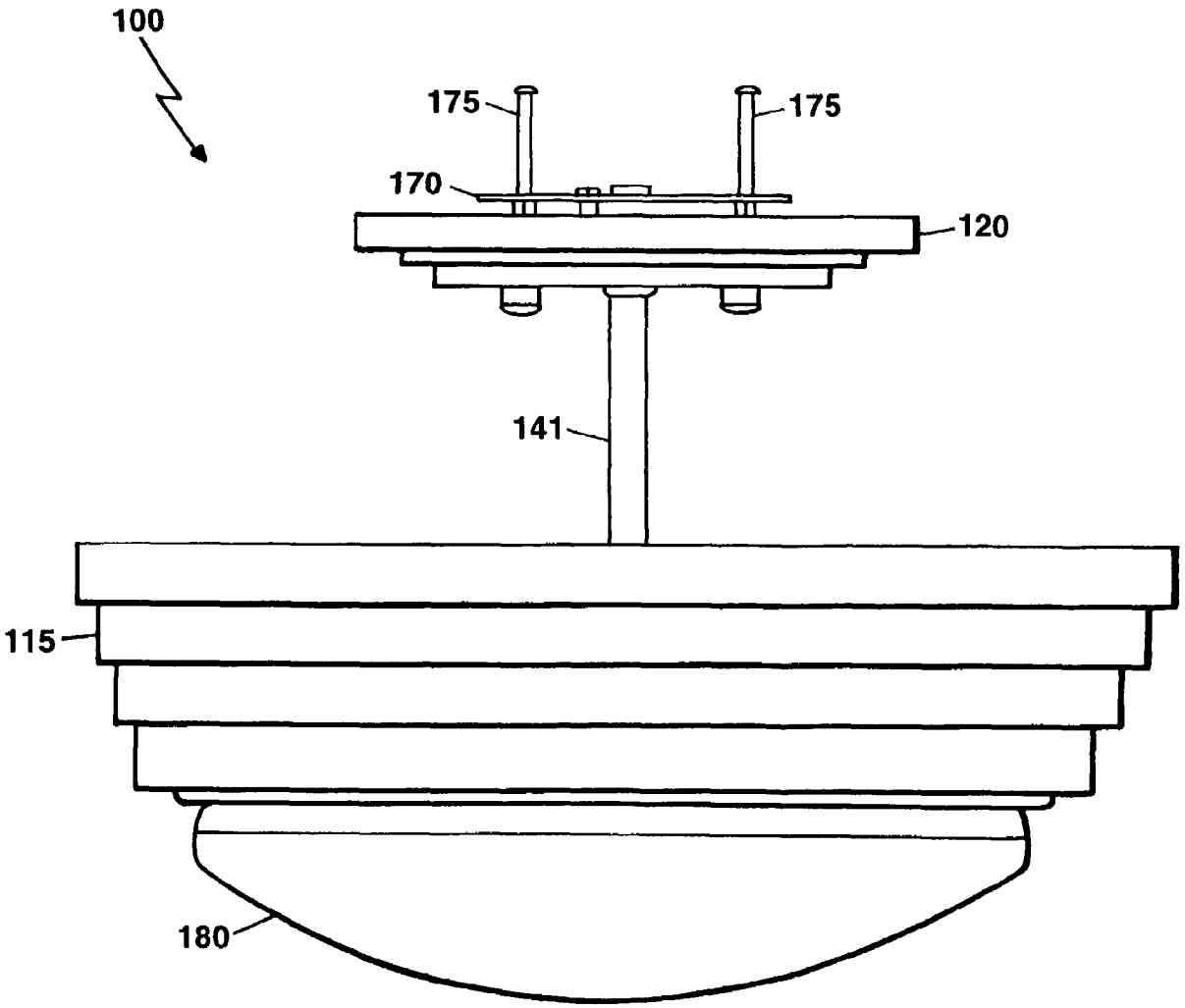
FIG. 3 is a side view of an alternative embodiment light fixture according to principles of the invention.

FIG. 3 is a side view of an alternative configuration of the lamp system 100 configured for semi-flush mounting. The diffuser 180 is coupled to the mounting device 115. Only the center rod 141 is used to couple the mounting device 115 to the mounting plate 120. The mounting plate is coupled to the cross bar 120 for mounting to a ceiling. In both the configurations shown in FIG. 2 and FIG. 3, the light fixture is held at a distance away from the mounting surface. In these arrangements, light coming through the apertures 135 in the mounting platform 130 (not shown in these views) provide some amount of indirect light reflected from the mounting surface.

Figure 4A:
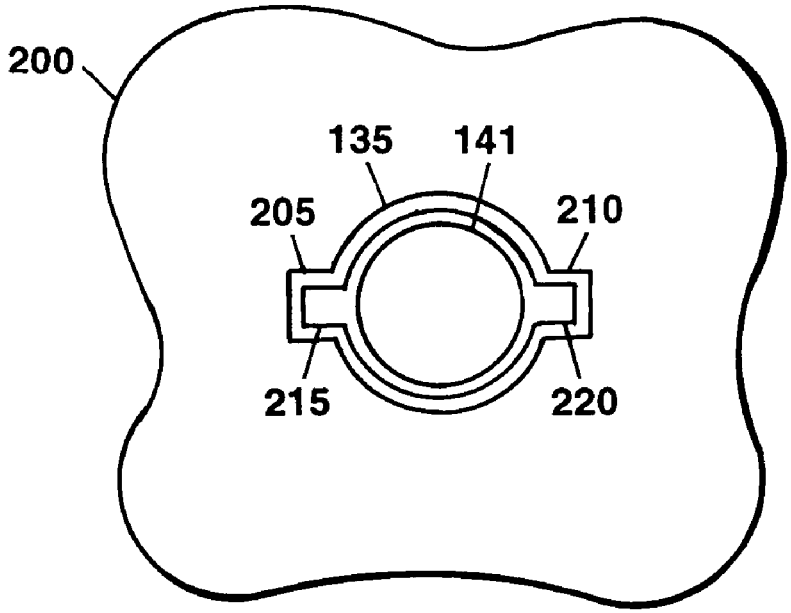
FIG. 4A is a bottom view of a locking rod fitted into an aperture according to one embodiment of the invention.

FIG. 4A is a bottom view of a locking rod fitted into an aperture according to one embodiment of the invention. A section 200 of the mounting platform 130 is shown with one of the apertures 135 for the mounting rods 141. In this embodiment, the aperture has a first slot 205 and a second slot 210 where the first and second slots 205, 210 are configured to receive a first protrusion 215 and a second protrusion 220 on the mounting rod 141.

Figure 4B:
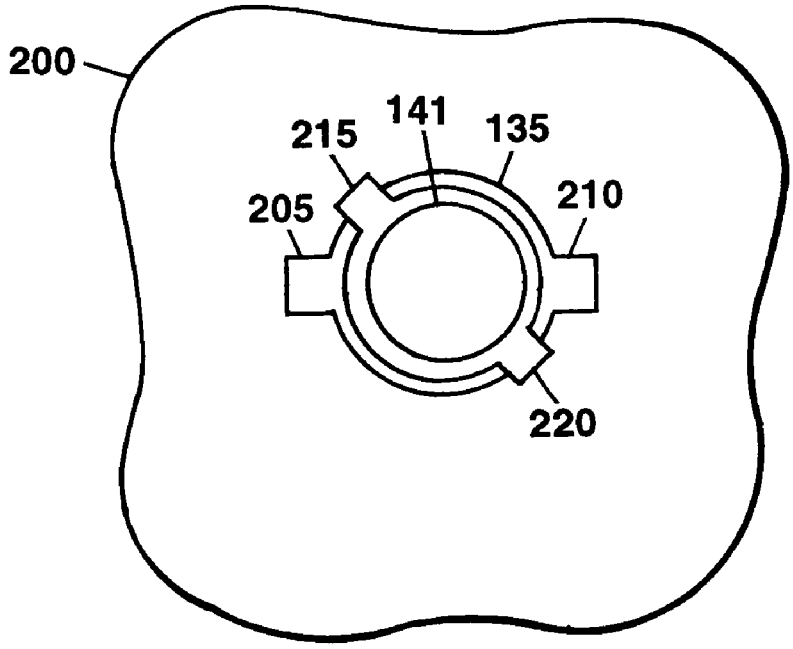
FIG. 4B is a bottom view of the locking rod of FIG. 4A in a locked position according to one embodiment of the invention.

FIG. 4B is a bottom view of the locking rod of FIG. 4A in a locked position according to one embodiment of the invention. In this view, the protrusions 215, 220 of the mounting rod have been pushed through the first slot 205 and the second slot 210. The mounting rod 141 was then rotated to dealing the protrusions 215, 220 with the slots 205, 210 in order to lock the rod.

Figure 5:
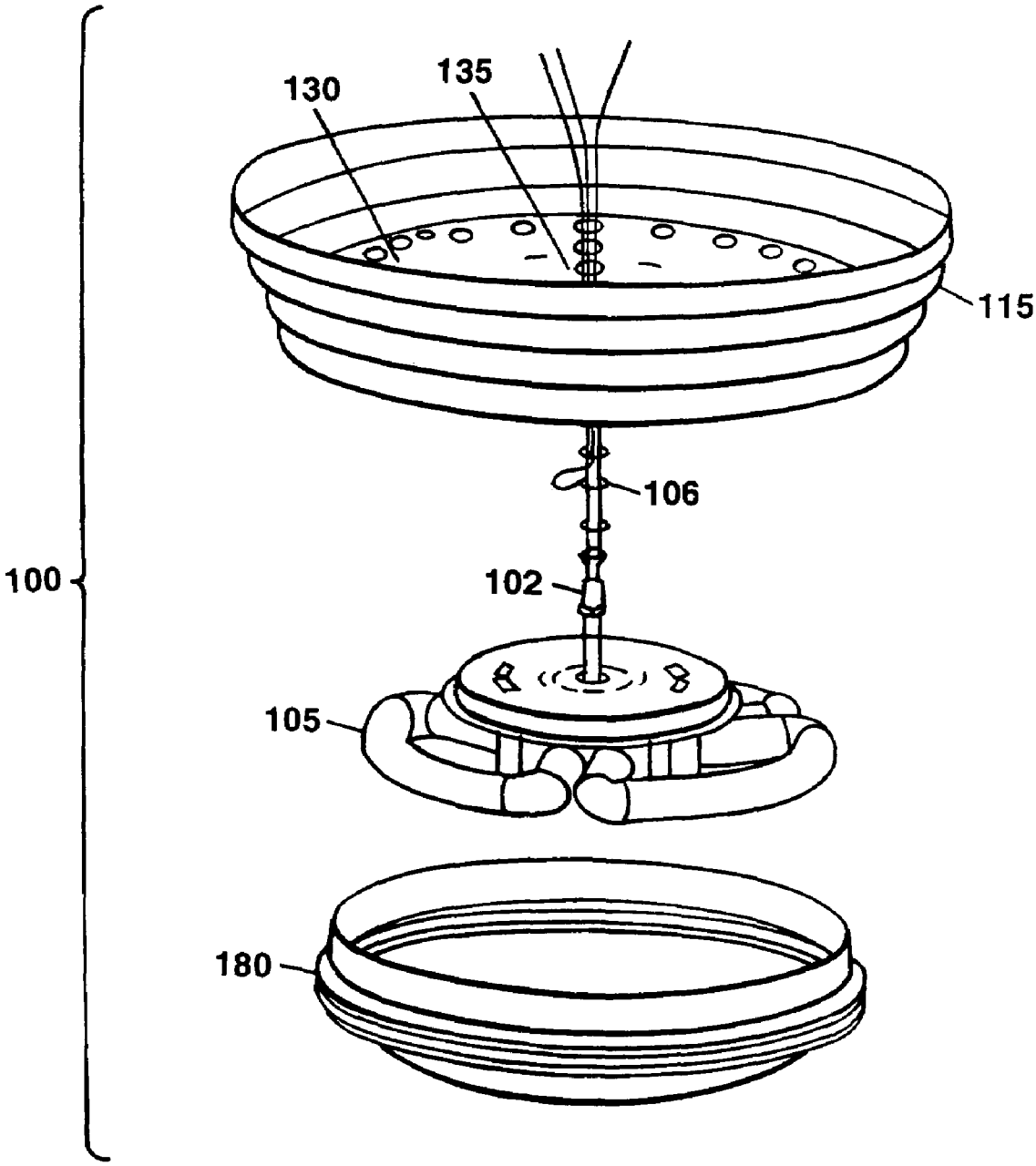
FIG. 5 is an assembly view of the light fixture of FIG. 1 in a flush mount configuration.

FIG. 5 is an assembly view of the lamp system 100 of FIG. 1 in a flush mount configuration according to one embodiment of the invention. The lamp system in this configuration includes the light fixture 105 and the diffuser 180. The light fixture 105 is coupled to the mounting device 115 with the center mounting stud 102. In this configuration, a flush mount is accomplished when the mounting device 115 is attached directly to the mounting surface using one of the apertures 135 in the mounting platform 130. The hollow center mounting stud and apertures in the mounting platform provide a channel for the lamp wiring.

Figure 6:
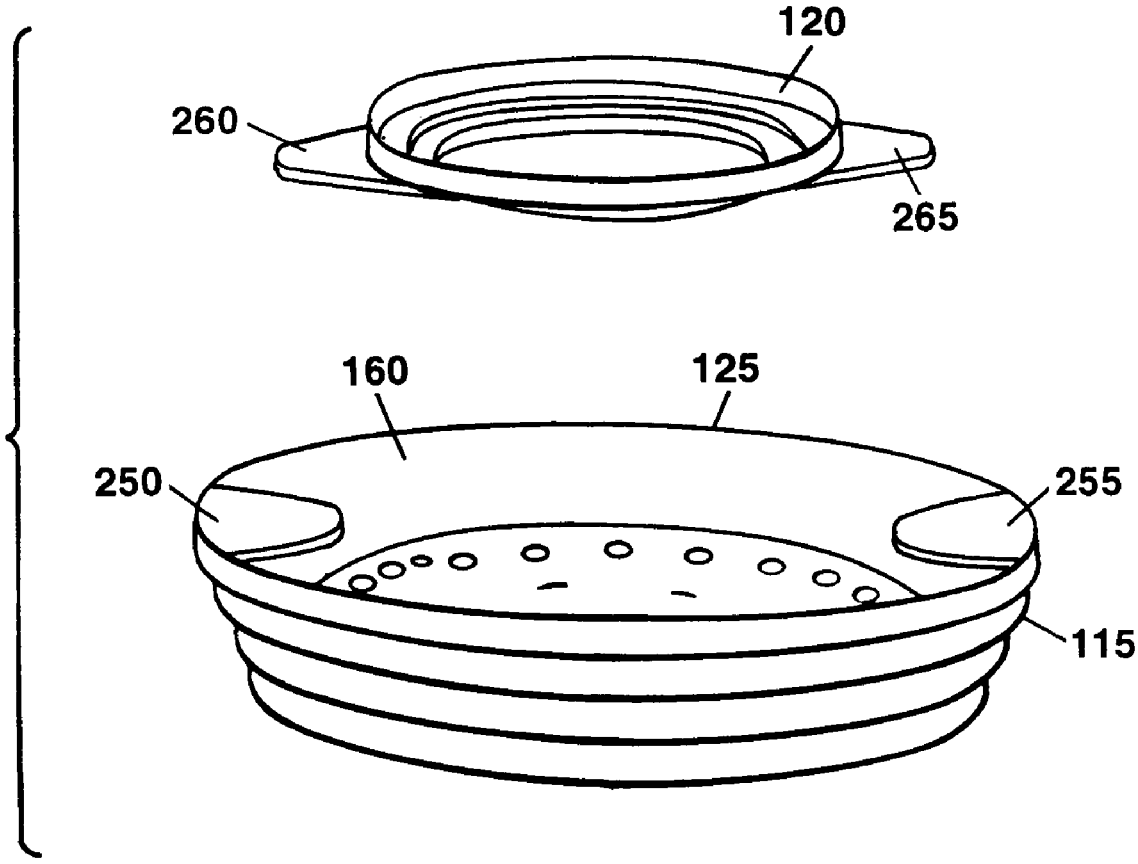
FIG. 6 is an assembly view of an alternative embodiment of the mounting system of the present invention.

FIG. 6 shows an alternative embodiment of the mounting device 115 and mounting plate 120 to accomplish a flush mount of the lamp system 100 according to principles of the invention. In this embodiment, a first tab 250 and a second tab 255 extend inward from the body 125 of the mounting device 115. A third tab 260 and a fourth tab 265 extend outward from the mounting plate 120. The first 250 and second 255 tabs are configured and located to overlap with the third 260 and fourth 265 tabs.

In the configuration shown in FIG. 6, a flush mount is accomplished when the third 260 and fourth 265 tabs are received into the cavity 160 of the mounting device 115 and the mounting device 115 is turned so that the first 250 and second 255 tabs rest on the third 260 and fourth 265 tabs.

Figure 7:
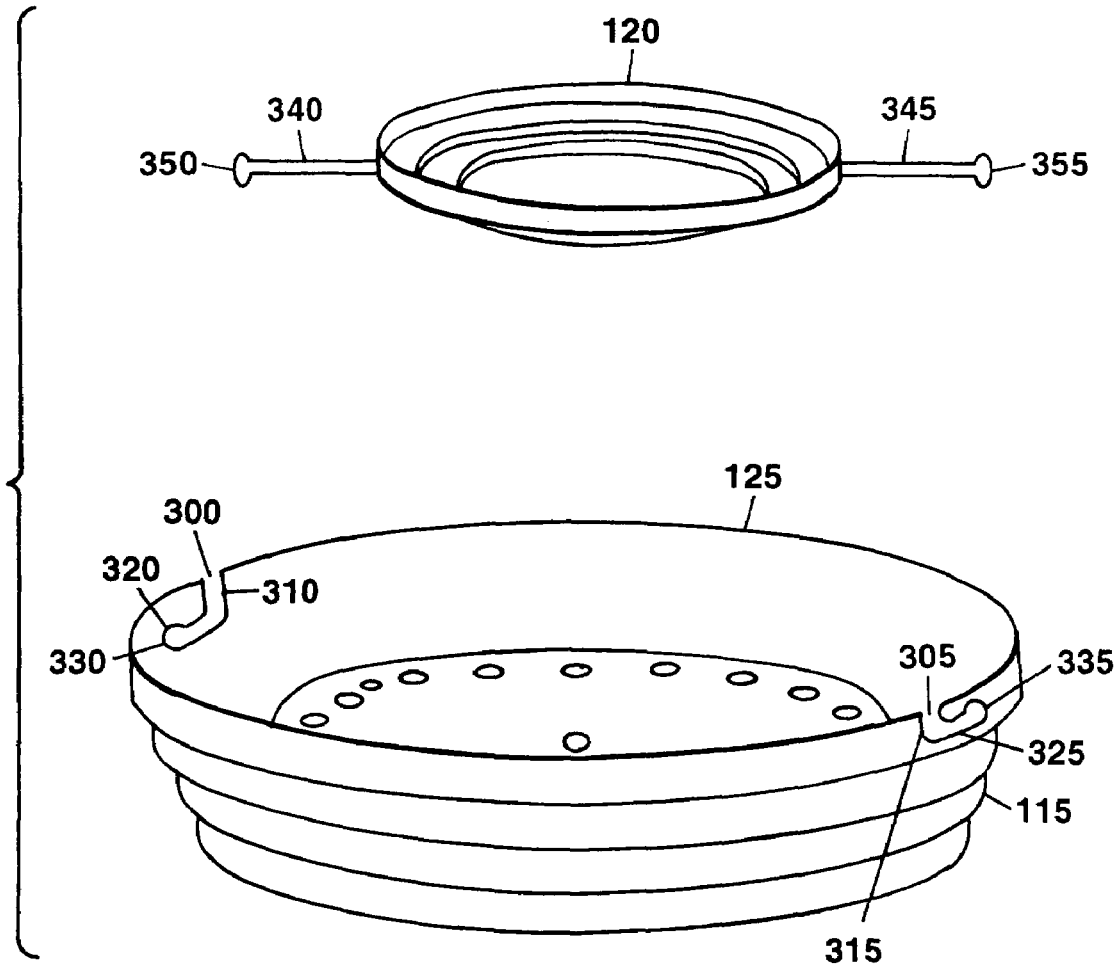
FIG. 7 is an assembly view of an alternative embodiment of the mounting system of the present invention.

FIG. 7 shows an alternative embodiment of the mounting device 115 and mounting plate 120 to accomplish a flush mount of the lamp system 100 according to principles of the invention. In this embodiment, the body 125 of the mounting device has a first mounting slot 300 and a second mounting slot 305. The first mounting slot 300 and second mounting slot 305 each have a vertical portion 310, 315 and a horizontal portion 320, 325. Additionally, each slot 305, 310 has an enlarged end 330, 335 or alternatively a second vertical portion. The mounting plate 120 has a first stud 340 and a second stud 345 extending radially.

The mounting slots 300, 305 are configured and positioned on the body 125 of the mounting device 115 in order to receive the first stud 340 and second stud 345. The first stud 340 and second stud 345 are configured and positioned to be received into the mounting slots 300, 305. In this embodiment, a flush. mount is accomplished when the studs 340, 345 are inserted into the mounting slots 300, 305 and the mounting device 115 is rotated so that the studs 340, 345 are lodged in the enlarged ends 330, 335 of the slots 300, 305. In one alternative embodiment, the heads 350, 355 of the studs 340, 345 are enlarged in order to prevent horizontal sliding of the mounting device 115.

Figure 8:
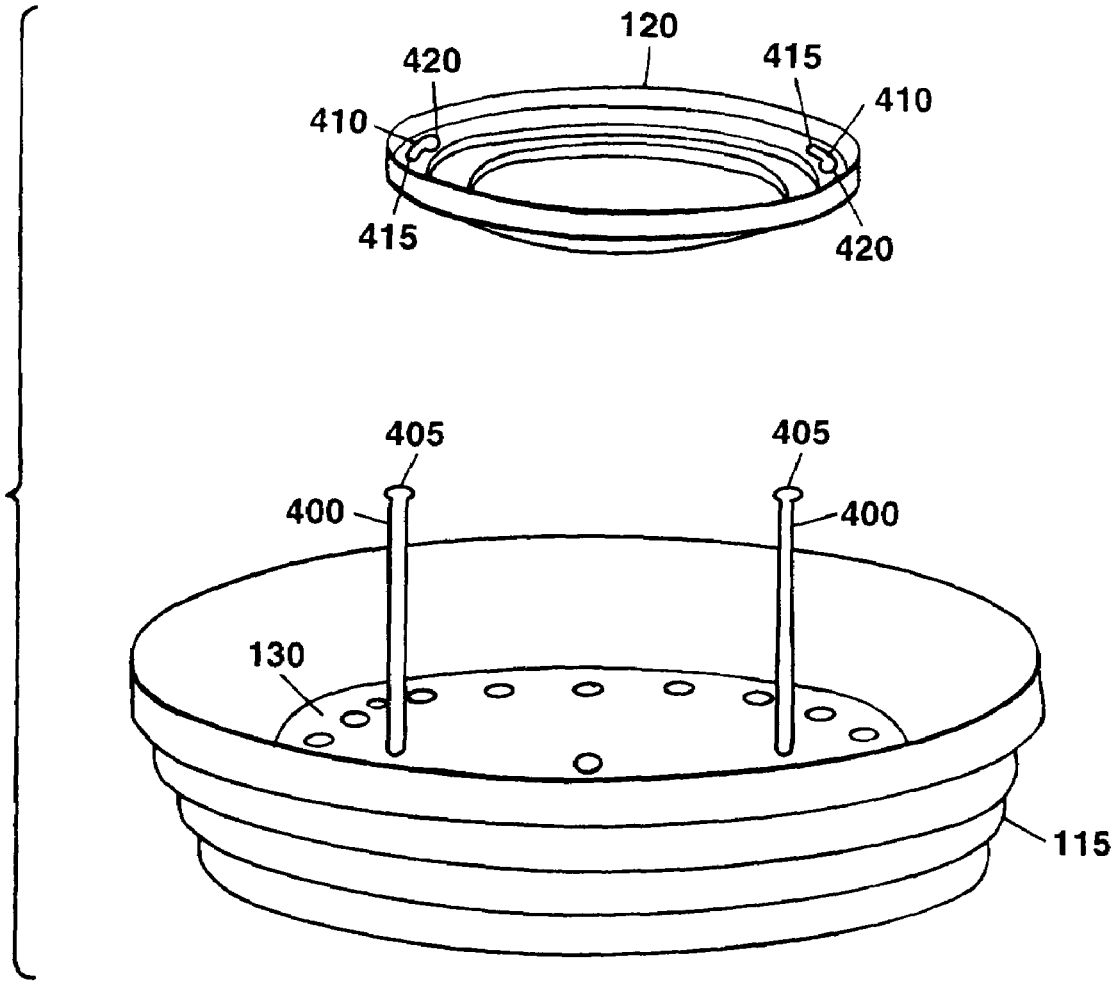
FIG. 8 is an assembly view of an alternative embodiment of the mounting system of the present invention.

FIG. 8 shows an alternative embodiment of the mounting device 115 and mounting plate 120 to accomplish a flush mount or a semi-flush mount of the lamp system 100 according to principles of the present invention. In this embodiment, pins 400 are attached to the mounting platform 130 of the mounting device 115. The pins 400 are positioned substantially perpendicular to the mounting platform 130. Further the pins 400 have enlarged heads 405. The mounting plate 120 has circumferential slots 410. Each circumferential slot 410 has a small end 415 and a large end 420. The slots 410 are shaped and configured to receive the pins 400. The large ends 420 are adapted to receive the enlarged heads 405 of the pins 400. The small ends 415 are adapted to be smaller than the enlarged heads 405 of the pins 400 but not smaller than the pins 400 themselves. For a flush mount, the pins 400 are short, for example a similar length as the side wall of the mounting cavity 160 of the mounting device 115. For a semi-flush mount, longer pins are used.

In this embodiment, the mounting device 115 is coupled to the mounting plate 120 when the pins 400 are inserted into the circumferential slots 410. The mounting device 115 is then rotated to position the heads 405 of the pins 400 at the smaller ends 415 of the circumferential slots 410.

One skilled in the art will understand that any of the embodiments shown in FIGS. 6-8 to accomplish a flush mount can be combined with the semi-flush mount and fan mount features shown in FIG. 1 in order to form a plural-mode mounting system 110 according to the principles of the invention. Further, an alternative embodiment of the mounting device 115 includes an embodiment that has the tabs 250, 255 shown in FIG. 6 and the mounting slots 300, 305 shown in FIG. 7 as well as connections for the pins 400 shown in FIG. 8.

Figure 9:
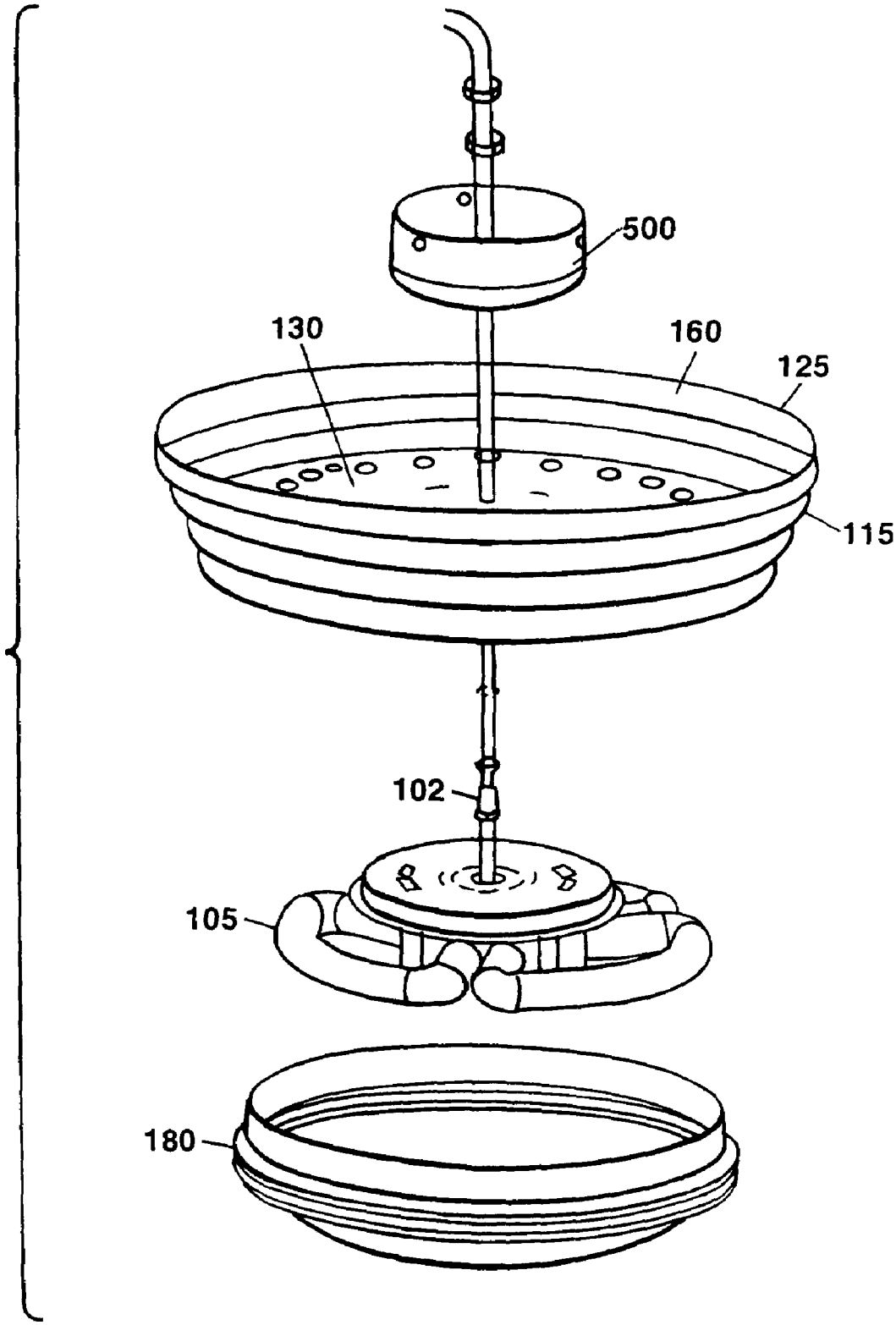
FIG. 9 is an assembly view of the light fixture of FIG. 1 in a fan mount configuration.

FIG. 9 is an assembly view of the light lamp system of FIG. 1 in a fan mount configuration according to principles of the invention. The lamp system in this configuration includes the light fixture 105 and the diffuser 180. The light fixture 105 is coupled to the mounting device 115 with the center mounting stud 102. The mounting device 115 has the cavity 160 formed by the inner surface of the body 125 and the upper surface of the mounting platform 130.

In this configuration, a fan mount is accomplished when a fan plate 500 (a part typically included with overhead fans) is received into the cavity 160 and coupled to the mounting device 115 through the center mounting stud 102. The hollow center mounting stud and apertures in the mounting platform provide a channel for the lamp wiring.

Figure 10:
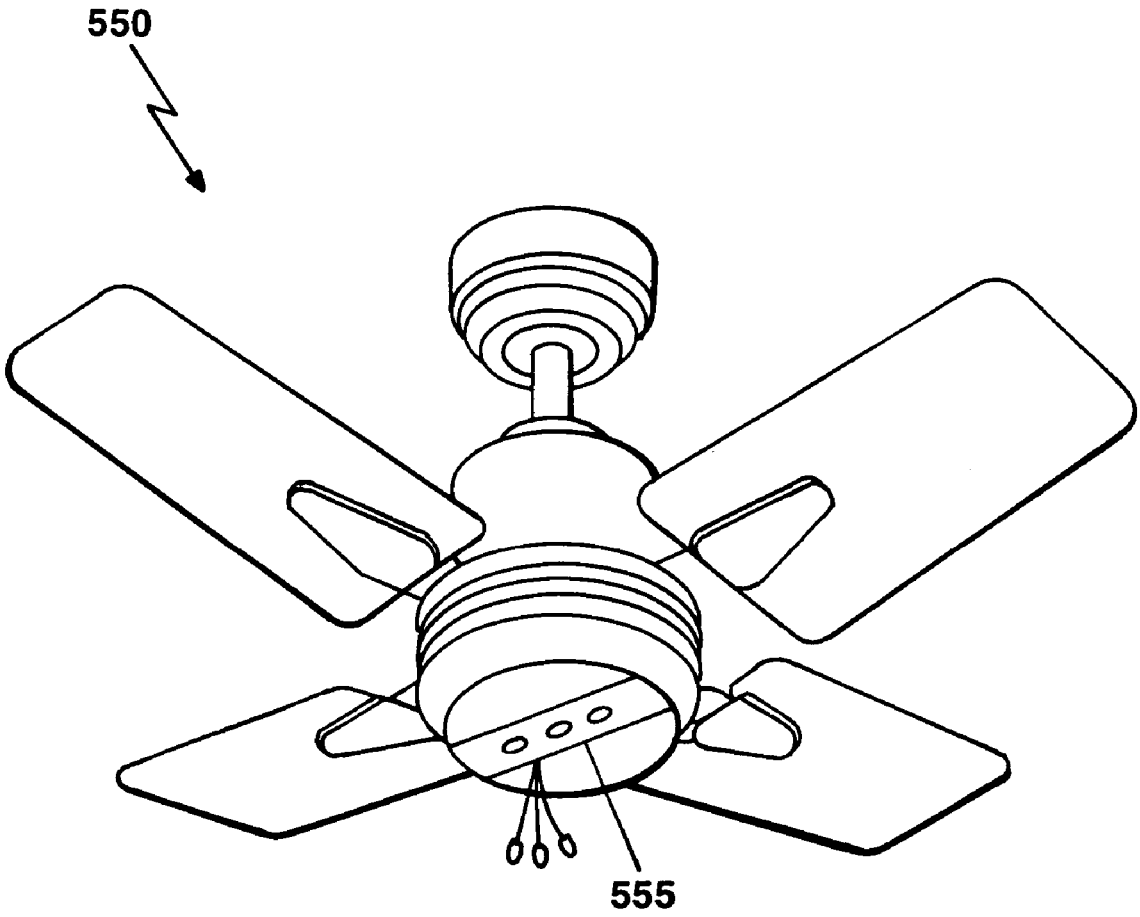
FIG. 10 is a three-dimension view of a ceiling fan having an alternative mounting bracket suitable for use with embodiments of the present invention.

FIG. 10 is a three-dimensional view of a ceiling fan 500 having an alternative mounting bracket 555 suitable for use with embodiments of the present invention. The ceiling fan 500 has a bracket 555 rather than a fan plate 500 shown in FIG. 9. A fan mount is accomplished when the cavity 160 of the mounting device 1 15 receives the bracket 555 and the bracket 555 is coupled to the mounting platform 1 15.

In the above-described embodiments, a central channel for lamp wiring is shown. In alternative embodiments of the invention, however, other apertures and features may be used to contain the wires. For example, each of the mounting rods 140, 141 could hold one of the wires 150, 152, 154.

It is to be understood that the above-identified embodiments are simply illustrative of the principles of the invention. Various and other modifications and changes may be made by those skilled in the art which will embody the principles of the invention and fall within the spirit and scope thereof.

We claim:

1. A mounting system for a light fixture, comprising:

a holder to receive a lamp;

a plural-mode mounting device coupled to the holder, the plural-mode mounting device to enable the holder holding a lamp to be mounted in one of a plurality of mounting modes wherein the plural-mode mounting device includes a cylinder and a disk mounted substantially coaxially inside the cylinder, the disk having an upper surface, the upper surface having at least one flush mount feature, at least one semi-flush mount feature and at least one fan-mount feature, wherein the at least one flush mount feature includes a center aperture to receive a center mounting stud to attach the light fixture to a ceiling brace in a flush mount manner, and wherein the plural-mode mounting device has a mounting cavity defined by the upper surface of the disk and the inner surface of the cylinder above the disk, the mounting cavity to receive the ceiling brace and the center mounting stud to enable the light fixture to be mounted in a flush mount manner, and a mounting plate having a smaller circumference than the cylinder, the mounting plate having a rim, the mounting plate further having a plurality of studs radially extending from the rim, the plurality of studs spaced apart, and wherein the upper edge of the cylinder has a plurality of slots each to receive one of the plurality of studs, each slot configured so that when the studs are received into the slots and the mounting device is turned, the light fixture and mounting plate are coupled.

2. The mounting system of claim 1 wherein the plural-mode mounting device enables the light fixture to be mounted in one of the plurality of mounting modes without alteration of the plural-mode mounting device.

3. A mounting system for a light fixture, comprising:

a holder to receive a lamp;

a plural-mode mounting device coupled to the holder, the plural-mode mounting device to enable the holder holding a lamp to be mounted in one of a plurality of mounting modes wherein the plural-mode mounting device includes a cylinder and a disk mounted substantially coaxially inside the cylinder, the disk having an upper surface, the upper surface having at least one flush mount feature, at least one semi-flush mount feature and at least one fan-mount feature, wherein the at least one flush mount feature includes a center aperture to receive a center mounting stud to attach the light fixture to a ceiling brace in a flush mount manner, and wherein the plural-mode mounting device has a mounting cavity defined by the upper surface of the disk and the inner surface of the cylinder above the disk, the mounting cavity to receive the ceiling brace and the center mounting stud to enable the light fixture to be mounted in a flush mount manner, and a mounting plate having a smaller circumference than the cylinder, the mounting plate having a rim, the mounting plate having at least two plate tabs extending radially outward from the rim and wherein the upper edge of the cylinder has at least two cylinder tabs extending radially inward from the cylinder, the at least two cylinder tabs located and configured to rest on top of the plate tabs thereby coupling the plural-mount mounting device to the mounting plate such that the light fixture is mounted in a flush mount manner.

4. The mounting system of claim 3 wherein the at least one flush mount feature having the mounting cavity defined by the upper surface of the disk and the inner surface of the cylinder above the disk receives the mounting plate and the plate tabs to enable the light fixture to be mounted in a flush mount manner.

5. A mounting system for a light fixture, comprising:

a holder to receive a lamp;

a plural-mode mounting device coupled to the holder, the plural-mode mounting device to enable the holder holding a lamp to be mounted in one of a plurality of mounting modes wherein the plural-mode mounting device includes a cylinder and a disk mounted substantially coaxially inside the cylinder, the disk having an upper surface, the upper surface having at least one flush mount feature, at least one semi-flush mount feature and at least one fan-mount feature, wherein the at least one flush mount feature includes a center aperture to receive a center mounting stud to attach the light fixture to a ceiling brace in a flush mount manner, and wherein the plural-mode mounting device has a mounting cavity defined by the upper surface of the disk and the inner surface of the cylinder above the disk, the mounting cavity to receive the ceiling brace and the center mounting stud to enable the light fixture to be mounted in a flush mount manner, and a mounting plate having a smaller circumference than the cylinder, the mounting plate having at least two circumferential slots, each said slot haying a larger end and a smaller end, wherein the at least one flush mount feature further comprises at least two pins having enlarged heads, the at least two pins extending upward substantially parallel to the axis of the cylinder, the at least two pins shaped and located to be received into the larger ends of the slots, the enlarged heads larger than the smaller ends of the slots such that the plural-mount mounting device and mounting plate are coupled when the pins are inserted into the slots and the mounting device is then turned so that the pins are located at the smaller ends of the slots whereby the light fixture is mounted in a flush mount manner.

6. The mounting system of claim 5 wherein the at least two pins are long such that the light fixture is mounted in a semi-flush manner.

* * * * *